US005187831A

United States Patent [19]

French

[11] Patent Number: 5,187,831

[45] Date of Patent: Feb. 23, 1993

[54] PARTS WASHER

[75] Inventor: Scott H. French, Rockford, Mich.

[73] Assignee: General Motors Corporation, Detroit, Mich.

[21] Appl. No.: 752,355

[22] Filed: Sep. 3, 1991

[51] Int. Cl.[5] ..... B08B 3/02

[52] U.S. Cl. ..... 15/302; 34/210; 134/151; 134/165

[58] Field of Search ..... 134/66, 72, 82, 83, 134/151, 165, 200; 15/302; 34/210, 214, 216, 217

[56] References Cited

U.S. PATENT DOCUMENTS

| | | | |
|---|---|---|---|
| 1,360,716 | 11/1920 | Blakeslee | 134/83 |
| 1,624,026 | 4/1927 | Utz | 134/82 |
| 2,944,557 | 7/1960 | Borodin | 134/165 X |
| 3,166,082 | 1/1965 | Arnold et al. | 134/200 X |
| 3,178,745 | 4/1965 | Kleebauer | 134/83 X |
| 4,079,919 | 3/1978 | Schober et al. | 134/83 X |

FOREIGN PATENT DOCUMENTS

| | | | |
|---|---|---|---|
| 756049 | 10/1951 | Fed. Rep. of Germany | 134/72 |

*Primary Examiner*—Philip R. Coe
*Attorney, Agent, or Firm*—Karl F. Barr, Jr.

[57] ABSTRACT

A parts washer for cleaning individual parts is disclosed having a compartmentalized washing enclosure housing individual washing and drying chamber which are separated by slideable partitions which open to admit parts, close to isolate parts during a particular washing operation, and open to release parts to a subsequent chamber. The partitions are operated in a predetermined sequence by pivoting arms which are acted on by positive motion cams mounted on a motor driven camshaft. The wash chambers have nozzles connected to a cleaning medium supply for directing cleaner such as hot water or steam onto the part to be cleaned in a predetermined pattern for optimized cleaning and, similarly, the drying chambers utilize nozzles connected to a source of dried, compressed air to dry the heated parts. A feed track moves the parts to be cleaned from the parts source, such as a manufacturing machine, to and through the parts washer.

5 Claims, 5 Drawing Sheets

PARTS WASHER

BACKGROUND OF THE INVENTION

Field of the Invention

The present invention relates to a parts washer for use in cleaning dirt, grease, machining debris, and other contaminants from the surfaces of individual parts and, more particularly, to a parts washer for individual parts utilizing an alternative washing method to freon-based corpane degreasers.

A typical method for cleaning individual parts during manufacturing is with freon-based degreasers in which parts are typically batch cleaned by submersion in the highly volatile liquid degreaser. Environmental concerns over the use of this class of solvents has led to a search for alternative methods of cleaning parts and substitutes for the freon-based degreasers.

SUMMARY OF THE INVENTION

In accordance with the present invention, a parts washer for use in cleaning individual parts is disclosed. The washer comprises a compartmentalized washing enclosure having individual washing and drying chambers. The chambers are separated by slideable partitions disposed therebetween. The partitions open to allow the parts to enter a chamber, close to isolate the parts during a particular washing operation, and open to release the parts to a subsequent chamber. The partitions are operated in a predetermined sequence by pivoting arms which are acted on by an electric motor driven camshaft.

The wash chambers utilize a cleaning medium which is connected to a manifold located outside of the chamber, from where it is distributed to a plurality of individual nozzles which are disposed within the wash chambers. The nozzles are oriented so as to optimize part cleaning. A drain in the wash chamber removes the cleaning effluent and may be assisted in the removal of waste by the application of vacuum. The cleaning medium may comprise hot water, hot water with an added cleaner such as a surfactant, steam which may be supplied from the boilers of a manufacturing facility, or any other suitable agent or combination thereof, which will generally depend upon the cleaning requirements of the particular parts.

Washed parts are subsequently moved to a drying chamber where they are subjected to dried, compressed air. The parts typically will have an elevated temperature when the cleaning medium used is steam or hot water and, as a result, will flash dry thereby minimizing the incidence of oxidation. Vacuum may also be applied to the drying chambers to assist in moisture removal..

Supply of the parts to the washer and conveyance of the parts through the various wash chambers is dependent upon the type, size, quantity, and other characteristics of the parts, and process with which the washer is integrated. The configuration of the disclosed parts washer lends itself to use with several means for conveying parts which are well know, such as belts and indexing apparatus for larger parts. The part feed system of the washer disclosed comprises a track tailored to the dimensions of the particular parts to be washed. The track has multiple parallel, axially extending guides or rods which have a cross section and are spaced to support the parts with a minimum of surface occlusion. The track is designed to supply the parts through the use of gravity; however, the rods may be subjected to vibration to assist movement of the parts. The track is segmented through the part washer to accommodate the operation of the slideable partitions. Because the disclosed system operates on a gravity feed principle, a part indexing stop is provided at the entrance to the part washer. The indexing stop acts to regulate the parts present at the entrance to the first chamber so as to regulate the number of parts entering the washer. The indexing stop is operated by a rocker arm which is acted on by the camshaft that actuates the chamber partitions.

The use of the feed system of the present invention allows the incorporation of the washer directly into the manufacturing operation. The unit is compact in size and the controls for the unit can easily be integrated with the controls of the associated manufacturing machine. Such synchronous manufacturing eliminates steps required in conventional batch washing techniques where the washing of parts is a separate processing step.

Also, the use of cleaning mediums such as hot water or system steam to wash the parts eliminates the environmental hazards and cost inherent in the use of freon-based degreasers.

The use of cleaning medium such as hot water and steam in the present invention has the additional benefit of improving the overall cleaning process because the cleaning medium is used only once whereas in the freon-based system the cleaning medium is filtered and reused.

Other objects and features of the invention will become apparent by reference to the following description and to the drawings.

DESCRIPTION OF THE PREFERRED EMBODIMENT

Throughout the description of the parts washer which follows, several features having similar design or function are described by the same numeral designator with a letter suffix to denote the specific feature. For the sake of clarity, however, where the description of the various parts is similar, thereby applying to each of the parts having the same numeral designator, only the numeral designator is used.

Figure 1:
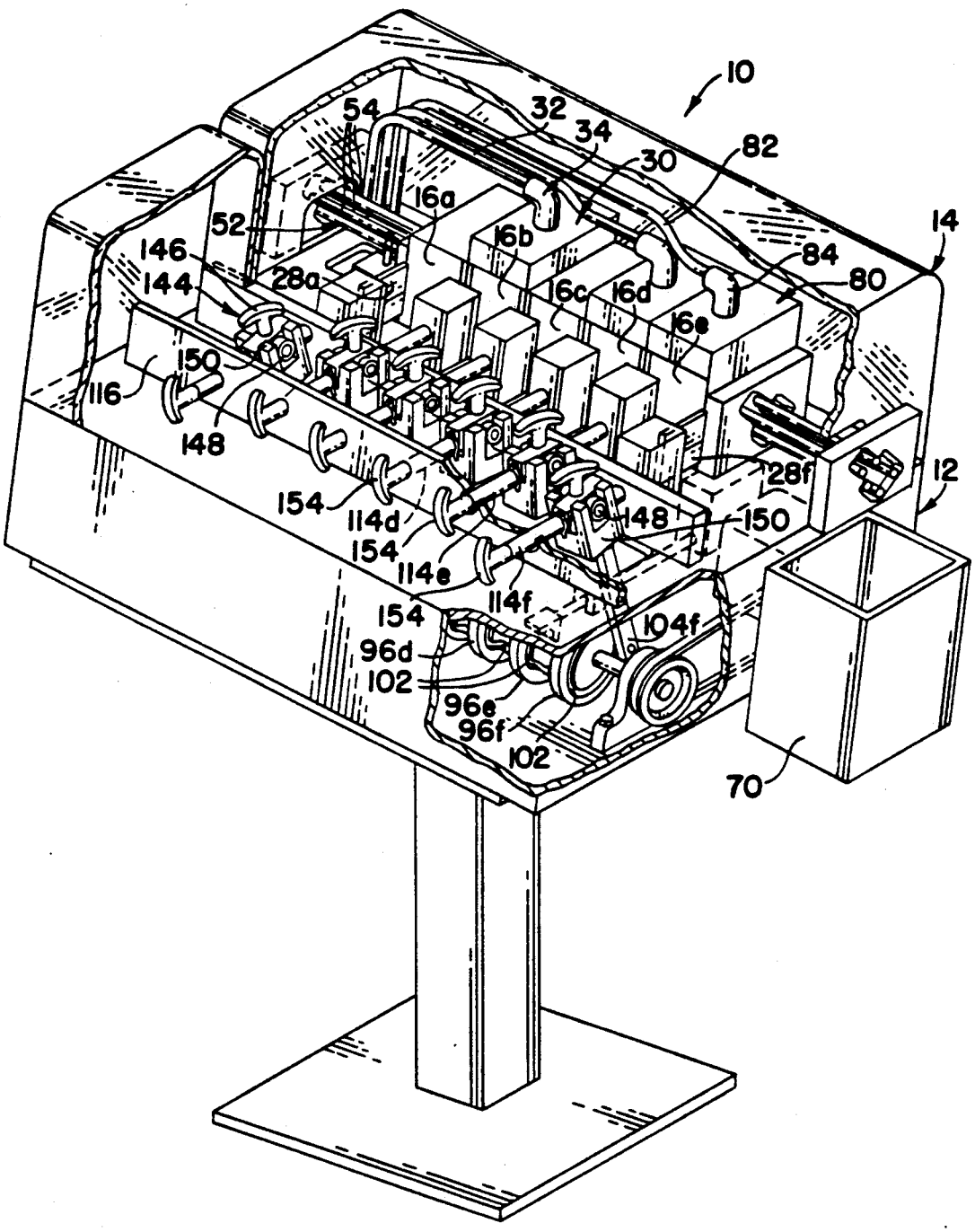
FIG. 1 is a perspective view, partially in section, of the parts washer of the present invention.

In FIG. 1 there is shown a parts washer designated generally as 10, useful for the removal of dirt, grease, machining debris, and other contaminants of the manufacturing process from the surfaces of individual part(s) "p". The washer 10 comprises a lower base portion 12 best shown in FIGS. 3 and 4, and an upper enclosure portion 14 best shown in FIGS. 1, 6, and 7.

Figure 5:
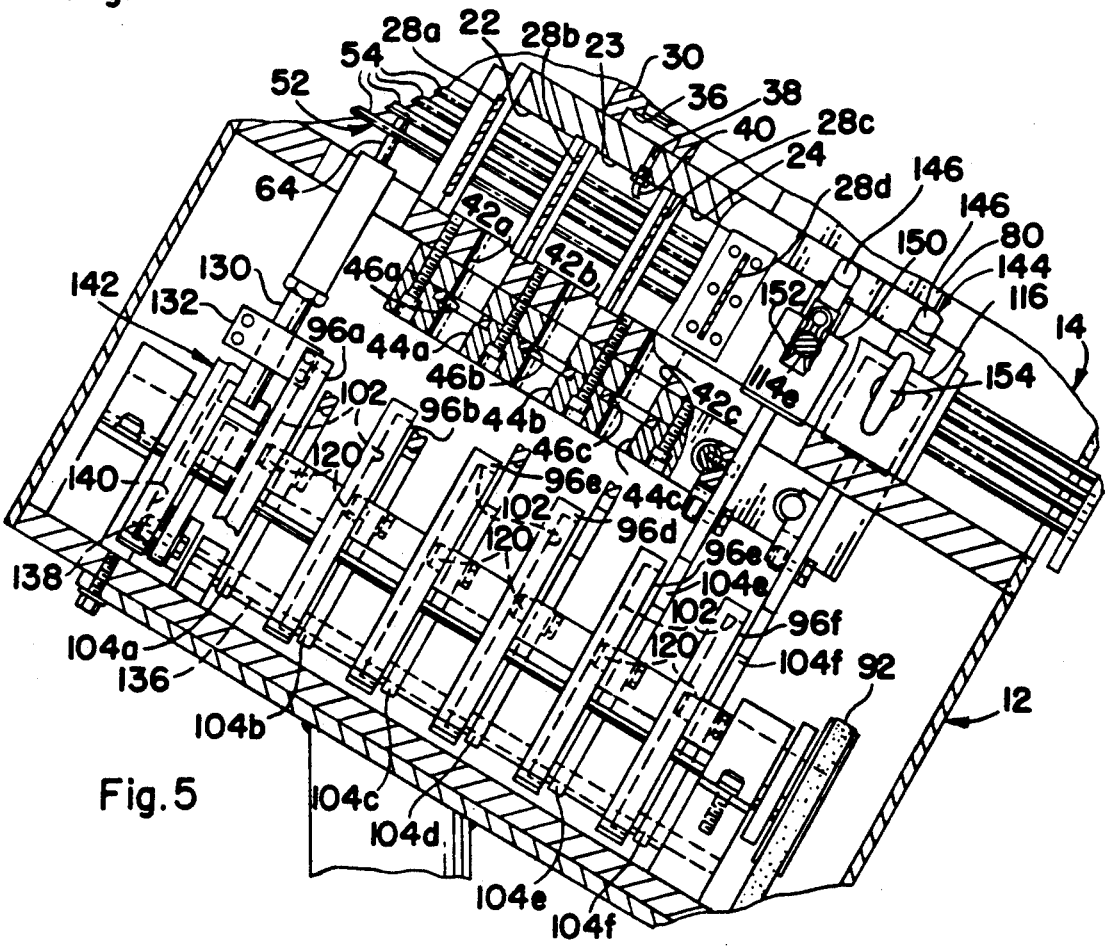
FIG. 5 is a partial sectional view taken along line 5—5 of FIG. 2.

As shown in FIG. 1, the upper enclosure portion 14 is divided into a number of enclosures 16*a–e*. Each enclosure has a chamber 22, 23, and 24, shown in FIG. 5, and 25 and 26 shown in FIG. 2 therein for the passage of part(s) "p" through the washer 10. The number of enclosures 16 in a particular parts washer 10 may vary and will depend on the cleaning operations required for a given part "p". The chambers are separated from one another by slideable partitions 28*a–f*. The partitions 28 operate to allow the parts to be cleaned to enter a chamber, isolate the parts by closing during a particular cleaning operation, and release the parts to a subsequent chamber, or from the washer 10, following the completion of the cleaning operation.

The chambers 22, 23, 24, 25, and 26 are grouped into different categories depending upon the cleaning operation to be carried out therein. In the parts washer illustrated in the Figures, chambers 22 and 24 are wait chambers where parts are held until movement to a subsequent chamber for a cleaning operation to be performed thereon. Wait chambers 22 and 24 give the operator the option of adding additional cleaning operations should the need arise.

Figure 7:
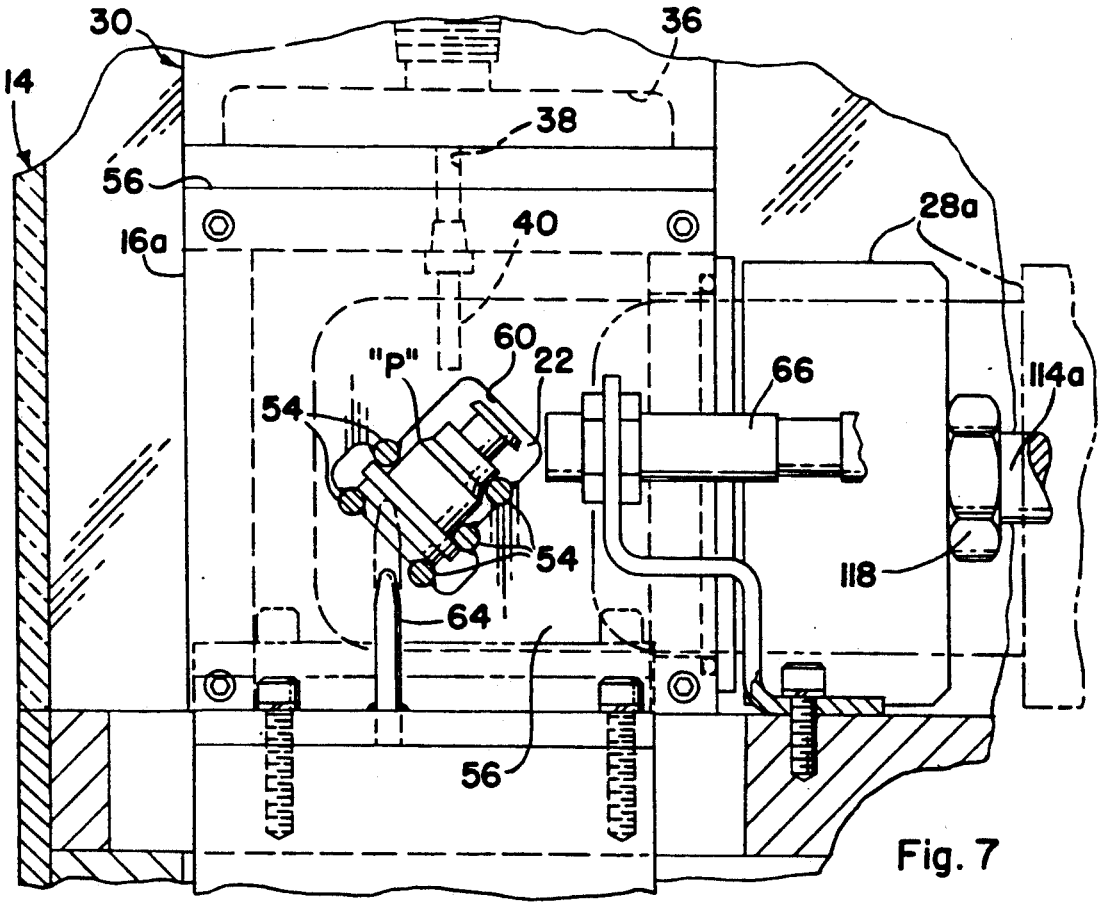
FIG. 7 is an end view of the enclosure portion of the present invention showing a part supported in the feed track.

Chambers 23 and 25 of the parts washer 10 are wash chambers where the parts are flushed of contaminants by a suitable cleaning medium. Since both wash chambers operate in a similar fashion, only chamber 23 will be described. The cleaning medium used in wash chambers 23 and 25 will vary depending on the specific cleaning operation which may be determined by the quantity and type of contaminants to be removed from the parts and the degree of cleanliness required. It is contemplated that any suitable cleaning medium may be used in the part washer disclosed; however, it is preferred to use a cleaning medium such as hot water, hot water combined with a surfactant, steam, or a combination thereof. In the embodiment disclosed, steam is the described cleaning medium. As shown in FIG. 1, steam manifold 30 is attached to the top of enclosure 16*b* and receives steam line 32 through coupling 34. As illustrated in FIG. 7, steam entering the manifold 30 is received within steam chamber 36 for distribution to nozzle passages such as 38. The nozzle passages 38 communicate with wash chamber 23 through steam nozzles 40. The nozzles 40 direct steam from chamber 36 onto the part(s) "p" to remove contaminants therefrom. For each application the number and configuration of the nozzles in each wash chamber will be specifically configured for optimized cleaning of the part(s) "p".

In order to remove residual cleaning medium and contaminants from the wash chamber 23, a drain 42 is formed in the bottom thereof. The drain is connected to drain line 44 and, although satisfactory results may be obtained by allowing the effluent to enter the drain 42 under the influence of gravity, it is preferred to apply vacuum to the drain line 44 to assist in the removal of the waste. It is desirable to disengage the vacuum line from the chamber 23 as the part(s) "p" leave the chamber in order that the vacuum applied to the drain 42 does not interfere with the movement thereof. Deactivation of the vacuum may be accomplished through the use of a vacuum paddle 46, disposed for reciprocal travel within paddle slot 47. Paddle 46 operates reciprocably, the operation of which will be described in further detail below, in concert with partition 28*c*, disposed between chamber 23 and 24 to position drain opening 50 formed in paddle 46 in alignment with drain 42 and drain line 44 when the partition is in a closed position and the washing operation is taking place. Upon opening of partition 48 following the wash operation, paddle 46 slides so that the opening 50 is not aligned with drain 42 thereby closing off communication between drain line 44 and drain 42 thereby deactivating vacuum to chamber 23 and allowing part(s) "p" to freely move to chamber 24.

Figure 2:
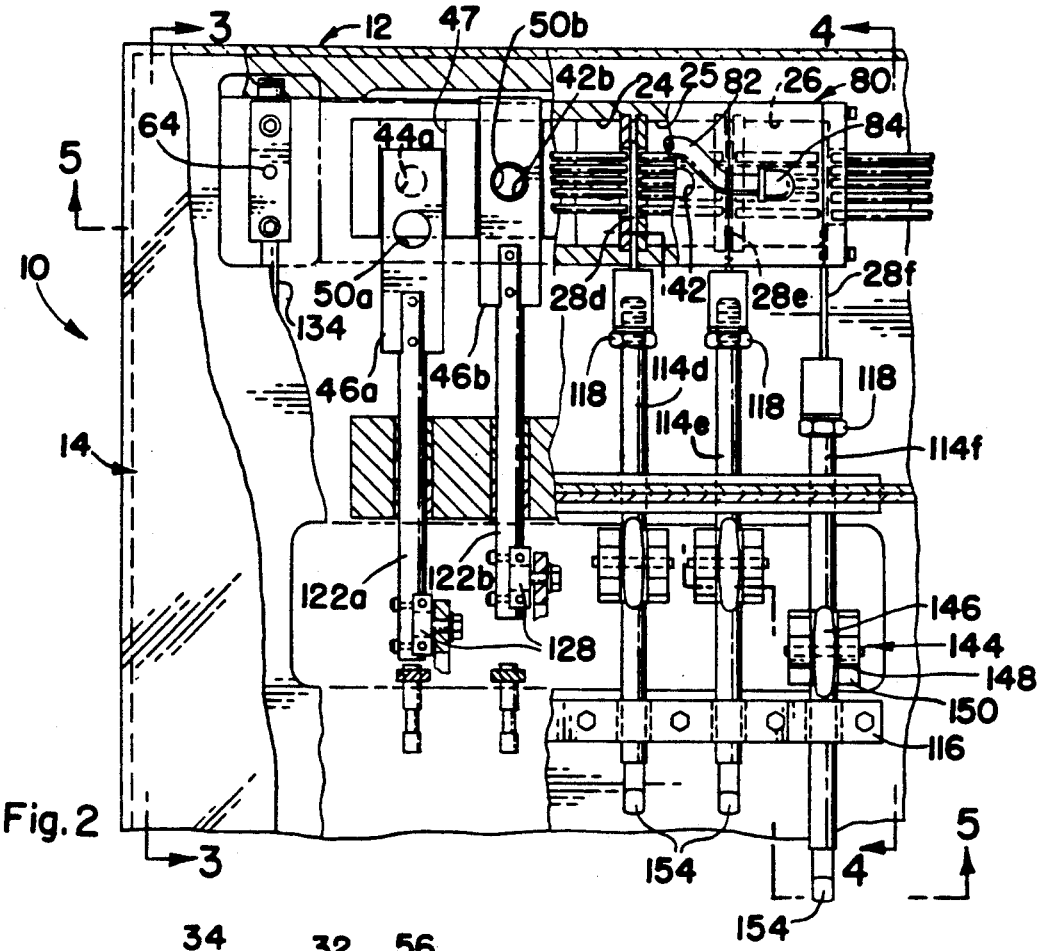
FIG. 2 is a partial plan view showing details of the washer of FIG. 1.
Figure 4:
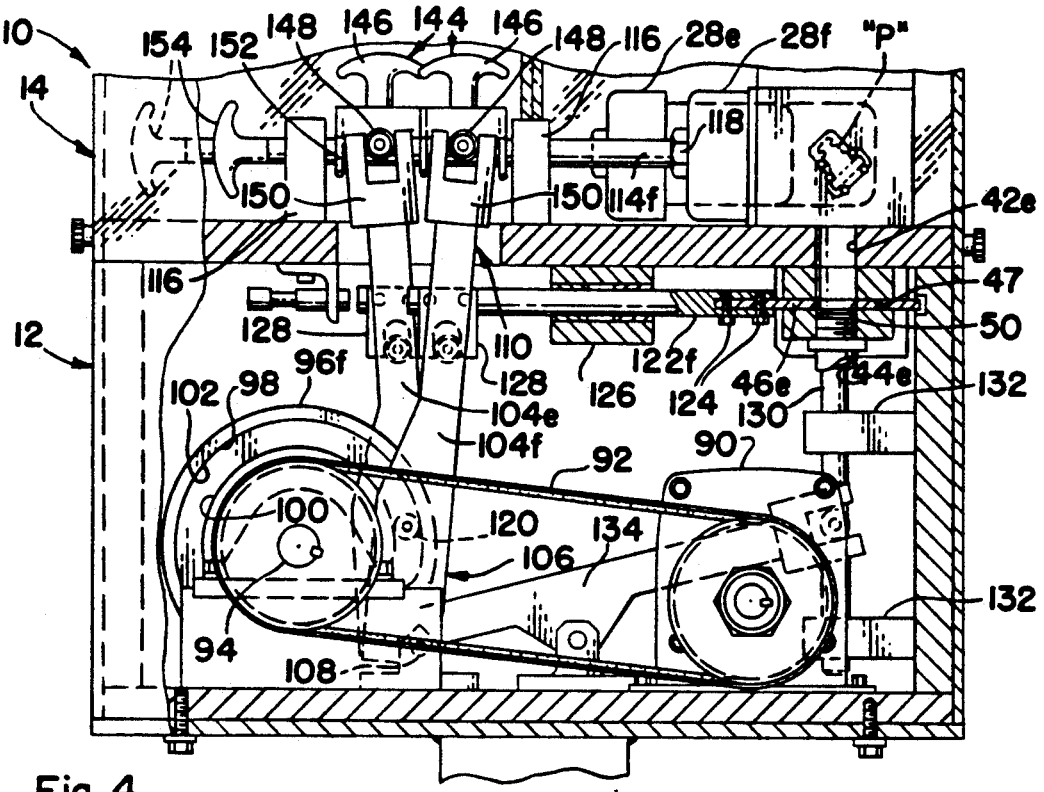
FIG. 4 is a partial sectional view taken along line 4—4 of FIG. 2.

It is desirable to install drain 42, drain line 44, and paddle 46, at each chamber regardless of the operation taking place therein, see FIGS. 2, 4, and 5. Such installation provides added flexibility in using the parts washer 10 in different configurations.

Figure 6:
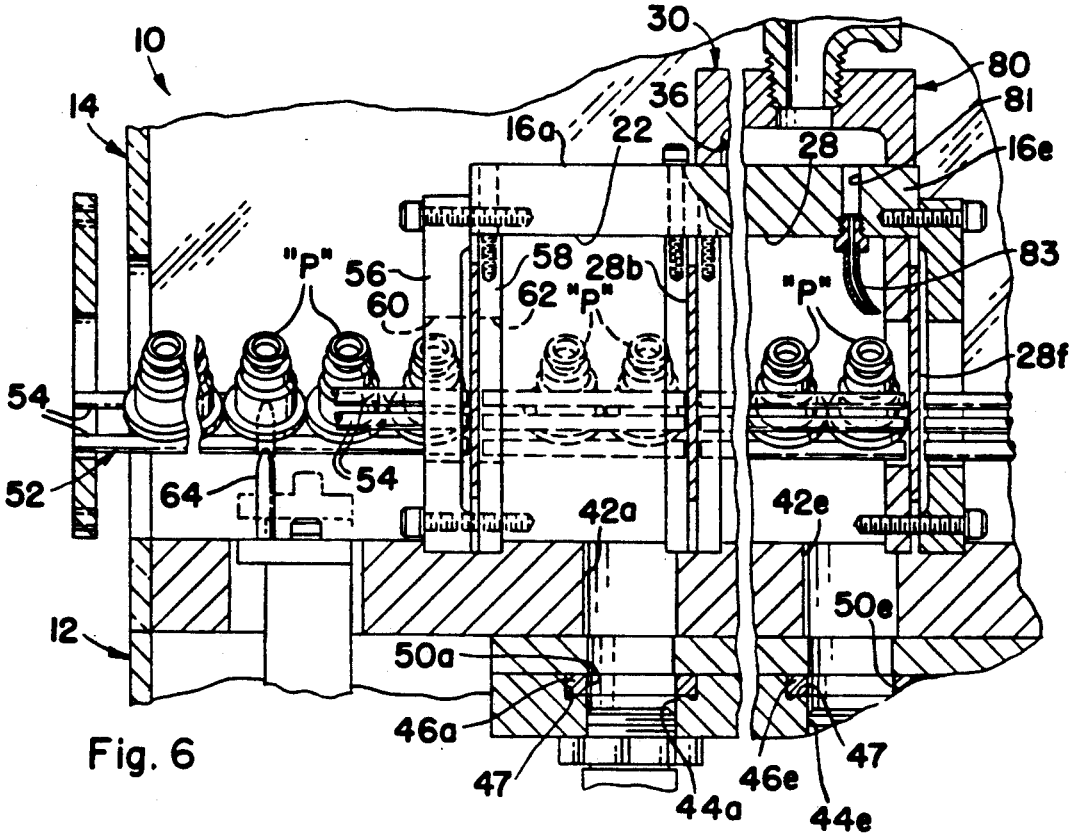
FIG. 6 is a partial sectional view of a portion of the wash enclosure of the present invention.

Following the second wash operation in chamber 25 of enclosure 19, the partition 28*e* between chambers 25 and 26 opens to allow the cleaned part(s) "p" to enter drying chamber 26 situated in enclosure 16*e*, see FIG. 6. Attached to the top portion of the enclosure 16*e* is air manifold 80 which receives dried, compressed air through air line 82 attached to the manifold 80 with coupling 84. The air is distributed through air passages 81 to precisely positioned nozzles 83 in the same manner as the wash chamber 23 described above. Upon contact with the dried, compressed air, the part(s) "p" flash dry due to the high temperature of the part resulting from the application of the steam in the wash chambers 23 and 25. Flash drying minimizes surface oxidation of the part(s) "p". When a cleaning medium having a lower temperature is used, additional drying steps may be required to adequately dry the washed part(s). Vacuum may be applied to the drying chamber 26 to assist in the removal of moisture during drying. The vacuum is applied in the same fashion as in the wash chamber 23 described above.

Movement of part(s) "p" through the parts washer 10 is facilitated by a gravity feed track 52 comprising a plurality of parallel, axially extending rods 54 having a cross section and spacing so as to support part(s) "p" with minimum occlusion of the part surface. Feed track 52 is configured to support a specific part "p" to be cleaned in a given washer 10. As is evident from FIGS. 2 and 6, the rods 54 must be segmented as they pass through the chambers 22, 23, 24, 25, and 26 in order to accommodate the operation of the partitions 28. Segmenting of the rods within the chambers requires support for the rods 54 which is supplied in the form of chamber end walls illustrated in FIGS. 6 and 7. FIG. 7 shows the entrance to wait chamber 22 which comprises end wall 56 and end wall 58. The end walls 56 and 58 have openings 60 and 62, respectively, which are configured to accommodate the part(s) "p" and the ends of rods 54 which are fixed to the openings, as by welding. In this manner the track rods 54 in each of the chambers 22–26 are supported within the chambers in precise alignment with the rods in adjacent chambers thereby assuring a smooth flow of parts through the washer 10. The configuration of the feed track system 52 is well suited for interfacing with an associated processing machine (not shown). It is contemplated that as the parts cleaned in the part washer vary in size and configuration, movement of the parts will require different types of conveying systems, each suited to the particular part to be washed. The parts washer of the present invention is well suited to use with other types of conveying systems such as belts and indexing apparatus which use mechanical means to move the part(s) through the washer rather than gravity as in the disclosed embodiment. It is also contemplated that feed track 52 may be subjected to vibration as a way of assisting the movement of the parts along the track. The washers continuous washing operation eliminates the need for separate batch washing of parts thereby eliminating a step in the manufacturing process.

A part stop 64 is situated upstream of the end wall 56 of the first chamber 22. The stop 64 is actuated in a reciprocal manner, as shown in phantom in FIGS. 6 and 7, to control the number of part(s) "p" which may enter the chamber 23 during a given "partition-open" sequence. Should insufficient parts be present in the track 52, a proximity sensor 66 will detect this condition and signal the controller (not shown) to stop operation of the washer 10. Part(s) "p" exiting the washer 10 may be collected in a parts bin 70 or may be transported via a continuation of feed track 52 to a subsequent manufacturing operation.

Operation of the partitions 28 which control entry and exit of part(s) "p" to each of the chambers 22, 23, 24, 25, and 26, the paddles 46 which control vacuum to the respective chambers, and the part stop 64 which queues the parts entering the wash enclosure is through an electric motor-driven camshaft which operates various control linkages connected to the respective partitions, paddles, or stop. An electric motor 90 is mounted within the base portion 12 of the parts washer 10 and acts through drive means such as chain or belt 92 to rotatively operate camshaft 94 at a predetermined rotational velocity. Camshaft 94 has a series of positive motion cams 96*a–f* mounted thereon. The cams 96 each having two working profiles 98 and 100 which cooperate to define a follower slot 102 extending about the diameter of the cam.

Pivot arms 104*a–f* each having a first end 106 pivotally mounted at axis 108 of base portion 12 and a free end 110 extending upwardly into enclosure portion 14 are releasably connected to one of several partition drive rods 114*a–f*. The drive rods 114 are supported for reciprocable motion by bushings 116 and are connected to partitions 28*a–f* by connecting means such as bolts 118. As is shown in FIG. 5, pivot arms 104 are located adjacent to cams 96. Extending outwardly from each pivot arm 104, intermediate of ends 106 and 110 is a cam follower 120. The follower is configured to travel within cam follower slot 102 of its respective cam 96*a–f* to move free end 110 of the pivot arm 104, and its associated partition drive rod 114 with attached partition 28, in a reciprocal motion to open and close partition 28 thereby allowing the part(s) "p" to move between chambers 22, 23, 24, 25 and 26. By positioning the cams 96 relative to one another, the partitions can be made to operate sequentially for the smooth transition of parts through parts washer 10.

Connection of the pivot arms 104*a–f* to the partition drive rods 114*a–f* is through quick release couplings, designated generally as 144, of the type shown in FIGS. 4 and 5. The coupling 144 comprises handle 146 which carries positioning shaft 148. The shaft 148 cooperates with a corresponding slot formed in partition drive rod 114 and, additionally, with fork 150 of pivot arm 104 to retain the rod 114 and arm 104 in hinged relationship with one another. Spring clips 152 extend from handle 146 to engage spring grooves formed in the partition drive rods 114 and hold the positioning shaft 146 in engagement with the members. Should it be desirable to disconnect the partition drive rod 114 from the pivot arm 104, such as in the case of repair, handle 146 is pulled upwardly to release spring clips 152 and positioning shaft 148 from engagement with the members 104 and 114. The partition drive rod can subsequently be moved manually using handle 154 mounted on the end thereof.

In a similar manner to the chamber partitions 28 described above, chamber vacuum paddles 46 are connected, for reciprocal motion within drain paddle slot 47, to vacuum paddle drive rods 122 using connectors such as bolts 124. The drive rods 122 are supported for reciprocal movement by bushings 126 and are connected by bracket 128 to the central portion of pivot arms 104. As the pivot arms 104 systematically reciprocate under the influence of the positive motion cams 96 mounted to the cam shaft 94, the vacuum paddle drive rods 122 are similarly moved reciprocably to drive the vacuum paddles 46 reciprocably in sequence with the opening of the chamber partitions 28 connected to the respective pivot arm 104. As the paddle is drawn out of the enclosure 16, vacuum opening 50 is moved out of alignment with drain openings 42 and 44, as illustrated in FIG. 2, thereby closing off vacuum to the respective chamber 22, 23, 24, 25, or 26. As the respective partition 28 is closed, the pivot arm 104 moves paddle drive rod 122 and its associated paddle 46 back into enclosure 16 to realign paddle opening 50 with drain 42 and drain line 44 thereby re-establishing the presence of vacuum in the respective chamber.

Figure 3:
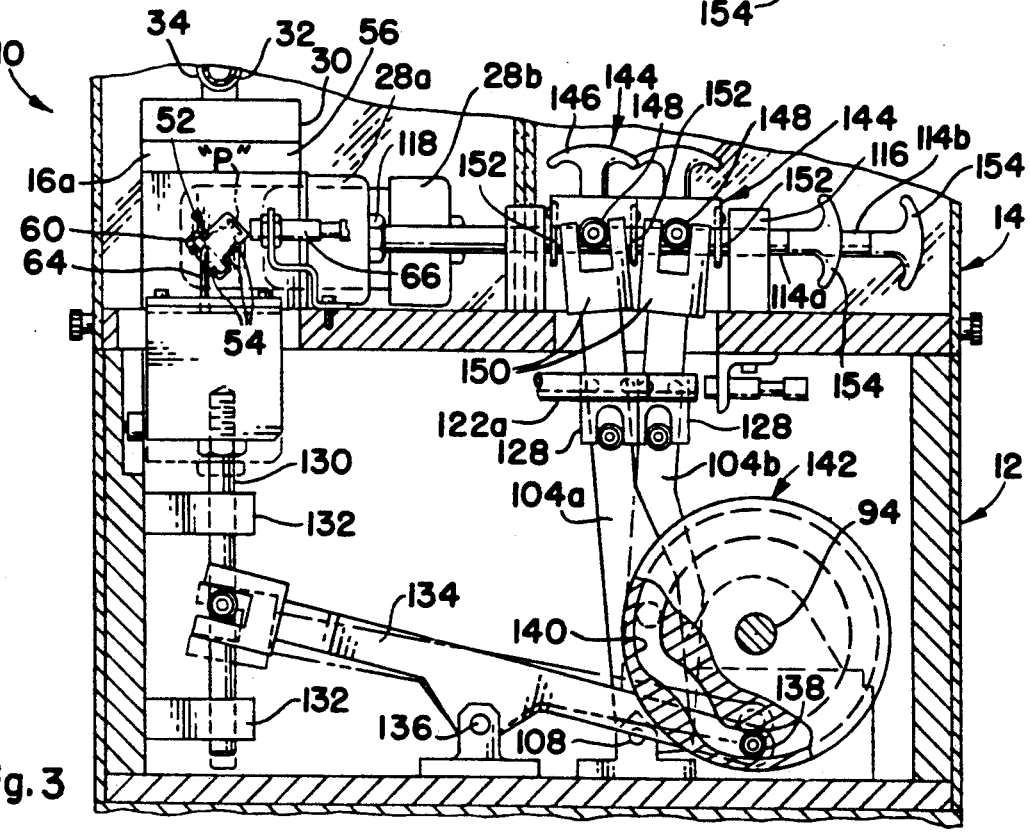
FIG. 3 is a partial sectional view taken along line 3—3 of FIG. 2.

Referring now to FIG. 3, part stop 64 which controls the admission of parts to the washer 10 is shown in a raised position where it acts to restrain parts in the feed track 52 from acting on the part(s) "p" waiting to enter the first chamber 22. The part stop is mounted to connecting rod 130 which is supported for reciprocal motion by bushings 132. At an intermediate position of the connecting rod 130, a pivot arm 134 acts on connecting rod 130 to drive the rod and attached part stop 64 into and out of an interference position relative to the part(s) "p" in the track 52 thereby regulating the number of parts available to enter the washer 10. The pivot arm 134 is mounted for the described desired pivotal motion at axis 136 attached to base portion 12. A second end of the pivot arm 134 has a cam follower 138 which travels within the follower slot 140 of positive motion cam 142 which is rotatably mounted to cam shaft 94. The profile of follower slot 140 is such that the pivot arm 134 cycles the part stop 64 to coordinate the movement of part(s) "p" into the washer.

Figure 8:
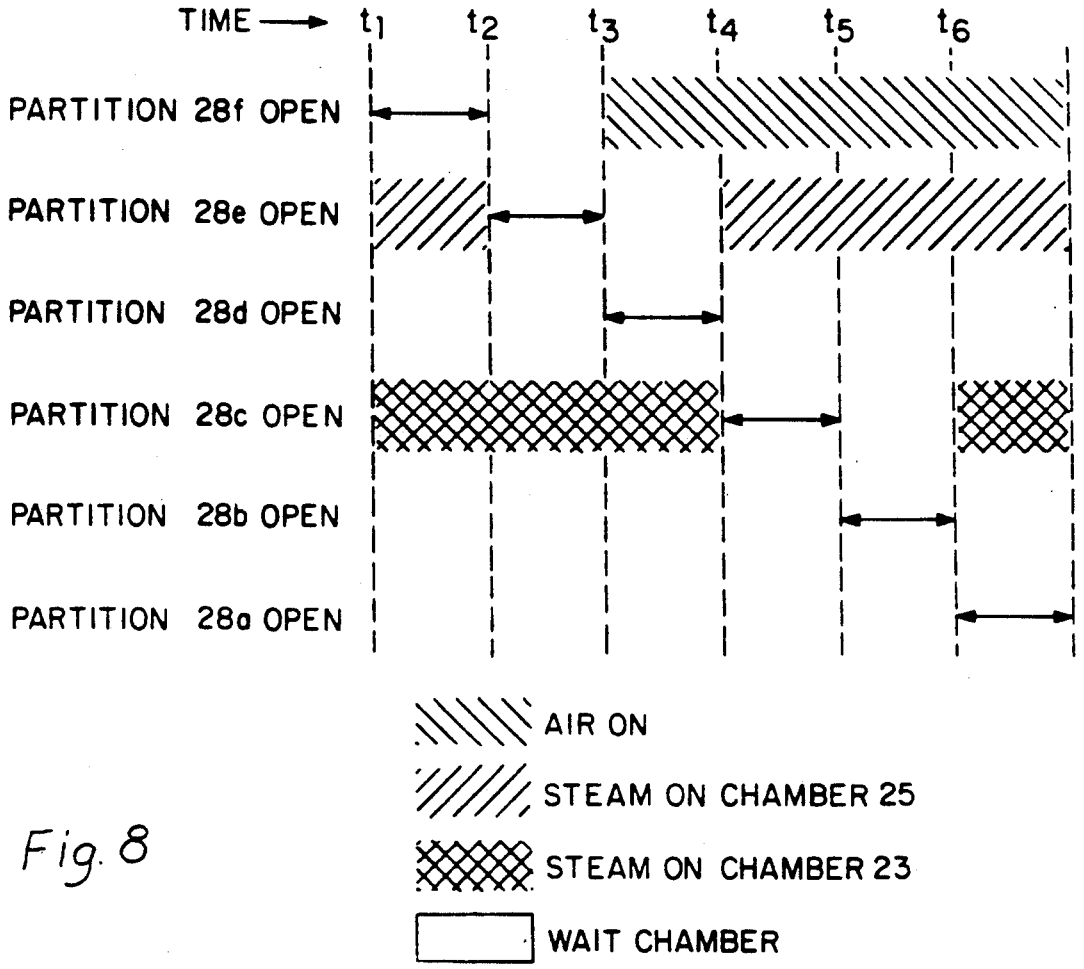
FIG. 8 illustrates the operation of the part washer of the present invention.

FIG. 8 is a timing diagram for the operation of a typical parts washer 10 of the type described. During normal cycling of the unit, the following sequence of events will occur, assuming the unit is already in operation and the chambers contain part(s) "p" which are at some stage in the cleaning process.

1. Partition 28*f* opens, turning off vacuum to drying chamber 26 if applied, and the cleaned and dried part(s) "p" in drying chamber 26 will drop into part bin 70. Partition 28*f* closes, restoring vacuum if applicable. Steam to the wash chamber 25 shuts off.

2. Partition 28*e* opens, turning off vacuum to wash chamber 25, and the part(s) "p" in the wash chamber 25 move to the drying chamber 26. Partition 28*e* closes, restoring vacuum to chamber 25, and the air to the drying compartment 26 turns on.

3. Partition 28*d* opens, turning off vacuum to wait chamber 24 if applied, and the part(s) "p" in the wait chamber 24 move to the wash chamber 25. Partition 28*d* closes, restoring vacuum to chamber 24 if applicable.

Steam to wash chamber 25 turns on. Steam to the wash chamber 23 shuts off.

4. Partition 28*c* opens, turning off vacuum to wash chamber 23, and the part(s) "p" in the wash chamber 23 move to the wait chamber 24. Partition 28*c* closes, restoring vacuum to wash chamber 23.

5. Partition 28*b* opens and the part(s) "p" in the wait chamber 22 moves to the wash chamber 23. Partition 28*b* closes. Steam to wash chamber 23 turns on.

6. Partition 28*a* opens to admit part(s) "p" waiting in the queue between part stop 64 and the partition 28*a*. Partition 28*a* closes and part stop 64 retracts to admit the next part(s) to the queue. Part stop 64 extends. Air to the drying chamber 26 turns off.

The parts washer 10 is not limited to the specific configuration described above. For example, it is contemplated that the mechanism for operating the partitions, paddles, and part stop may be replaced by hydraulic, pneumatic, or electric motors, which are controlled in their operation by a suitable controller.

It should be evident that the number of chambers and the sequence of events described is just one of many configurations of the parts washer 10 which is possible. The ultimate configuration will depend upon the cleaning task to be performed.

Additionally, although the parts washer 10 is described using one feed track 52 through the various chambers, it is contemplated that more than one feed track may be utilized to increase throughput of the washer.

The parts washer of the present invention is useful for cleaning contaminants from the surfaces of manufactured parts using many suitable cleaning mediums such as hot water and steam. The usage of the disclosed part washer has several advantages. The cleaning medium is utilized only once as opposed to freon-based cleaners which are filtered and reused which minimizes residual contaminants. By utilizing generally available hot water and steam, the freon-based cleaners can be removed from usage resulting in the elimination of a significant environmental concern. Generally available hot water and steam are significantly less expensive than chemical cleaners.

The washer of the present invention can be easily integrated with most production operations since it is of compact size which facilitates installation with current manufacturing equipment, and requires simplified controls which may be integrated into the control and operation of an associated machine.

While certain embodiments of the invention have been described in detail above in relation to a parts cleaner, it would be apparent to those skilled in the art that the disclosed embodiment may be modified. Therefore, the foregoing description is to be considered exemplary, rather than limiting, and the true scope of the invention is that described in the following claims.

The embodiments of the invention in which an exclusive property or privilege is claimed are defined as follows:

1. A parts washer comprising a compartmentalized wash enclosure having a wash chamber, a dry chamber, a conveying means for moving parts through said chambers, and slideable partitions for isolating said chambers during a washing operation, said wash chamber having an inlet, an outlet, and communication with a cleaning medium supply for supplying a cleaning medium to a series of nozzles disposed within said chamber, said nozzles oriented to spray said cleaning medium onto a part to be cleaned thereby removing contaminants therefrom, said dry chamber having an inlet for receiving parts from said wash chamber, an outlet, and communication with an air distribution means for supplying air to a series of nozzles disposed within said chamber, said nozzles oriented to release air onto a part to be dried following cleaning in said wash chamber, said slideable partitions being disposed at said inlet and outlet of said chambers and operably connected to connecting rods for sequentially driving said partitions, said connecting rods reciprocably operated by pivot arms having followers integral therewith which are operated on by cams positioned on a motor driven camshaft, said cams having profiles which act upon said followers to move said partitions in a predetermined sequence to admit a part into a chamber, isolate the part during a cleaning operation, and release the part following said operation.

2. A parts washer as defined in claim 1 said conveying means comprising fixed parallel, axially extending rods having a cross-section and oriented with respect to one another so as to support a part disposed therebetween and oriented to facilitate a sliding movement between the part and said axially extending rods.

3. A parts washer as defined in claim 2 said conveying means passing through said wash and dry chambers of said compartmentalized wash enclosure for transporting parts therethrough, said parallel rods segmented at said slideable partitions, said rod segments having ends fixed to end walls of said chambers which are disposed adjacent to said partitions.

4. A parts washer as defined in claim 2 said axially extending rods having a vibration source applied thereto for facilitating the movement of parts along said conveying means.

5. A parts washer as defined in claim 1 further comprising drain means integral with said wash chamber, said drain means communicating with a vacuum source to facilitate the removal of contaminants from said chamber and having a closure means comprising a reciprocably operating paddle disposed therein for regulating the application of said vacuum source to said drain means, said drain paddle connected to one of said pivot arms for engaging in said reciprocal movement in a predetermined sequence relative to said slideable partitions.

* * * * *